US006997716B2

(12) United States Patent
Skala et al.

(10) Patent No.: US 6,997,716 B2
(45) Date of Patent: Feb. 14, 2006

(54) CONTINUOUS AIMPOINT TRACKING SYSTEM

(75) Inventors: James A. Skala, Hartselle, AL (US); Frank J. Blackwell, Decatur, AL (US); Patrick W. Jungwirth, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/007,914

(22) Filed: Dec. 7, 2004

(65) Prior Publication Data

US 2005/0103924 A1 May 19, 2005

Related U.S. Application Data

(63) Continuation of application No. 10/103,748, filed on Mar. 22, 2002, now abandoned.

(51) Int. Cl.
*F41G 3/26* (2006.01)

(52) U.S. Cl. ..... 434/21; 434/17; 434/20; 273/348; 463/5; 89/41.05

(58) Field of Classification Search ..... 434/11, 434/16, 17, 19–23, 27, 365; 273/348; 463/3, 463/5; 345/156, 158, 179; 356/121, 141.5; 89/41.05; 348/136; 250/206.1; 701/302; 703/7

See application file for complete search history.

(56) References Cited

U.S. PATENT DOCUMENTS 3,951,550 A * 4/1976 Slick ..... 356/141.5
4,695,953 A * 9/1987 Blair et al. ..... 463/3
4,948,371 A * 8/1990 Hall ..... 434/21
5,196,689 A * 3/1993 Sugita et al. ..... 250/206.1
5,366,229 A * 11/1994 Suzuki ..... 463/5
5,379,676 A * 1/1995 Profeta et al. ..... 89/41.05
5,471,049 A 11/1995 Cain
5,577,733 A * 11/1996 Downing ..... 273/348
5,604,695 A * 2/1997 Cantin et al. ..... 356/121
5,641,288 A * 6/1997 Zaenglein, Jr. ..... 434/21
5,822,713 A * 10/1998 Profeta ..... 701/302
5,844,548 A * 12/1998 Chen et al. ..... 345/179
5,947,738 A * 9/1999 Muehle et al. ..... 434/16
5,982,352 A * 11/1999 Pryor ..... 345/156
6,269,730 B1 * 8/2001 Hawkes et al. ..... 89/41.05

(Continued)

OTHER PUBLICATIONS

"Study of Position Resolution with COPS" by Moromisato et al, Northeastern University, May 7, 1998, 20 pages.*

*Primary Examiner*—Joe H. Cheng
(74) *Attorney, Agent, or Firm*—Hay Kyung Chang

(57) ABSTRACT

The Continuous Aimpoint Tracking System is comprised of a position detection device (PDD) and a laser pointing device (LPD) that projects an infrared crosshair onto the PDD. The PDD is coupled to a computer and comprises a multitude of photodiodes and associated circuits, the photodiodes being evenly spaced and arranged to form a frame that can be mounted on the computer so as to surround the computer video display. When a "shot" is fired from the LPD, the crosshair projection is interrupted briefly. The PDD determines the position of the four crosshair intersections and reports them to the computer which, in response, generates the video signals that form the resolved aimpoint on the screen, matching the LPD aimpoint to the video image. Further, the tracking system determines the rotation of the LPD over a range of at least 10 degrees clockwise or counter-clockwise.

10 Claims, 3 Drawing Sheets

U.S. PATENT DOCUMENTS 6,441,804 B1 * 8/2002 Hsien ..... 345/158
6,604,064 B1 * 8/2003 Wolff et al. ..... 703/7
6,720,949 B1 * 4/2004 Pryor et al. ..... 345/158
2002/0012898 A1 * 1/2002 Shechter et al. ..... 434/21
2002/0163576 A1 * 11/2002 Ishino et al. ..... 348/136
2002/0197854 A1 * 12/2002 Kendir et al. ..... 434/21

* cited by examiner

CONTINUOUS AIMPOINT TRACKING SYSTEM

This application is a continuation of U.S. patent application Ser. No. 10/103,748, filed on Mar. 22, 2002, now abandoned, the subject matter of which is incorporated in its entirety by reference herein.

DEDICATORY CLAUSE

The invention described herein may be manufactured, used and licensed by or for the Government for governmental purposes without the payment to us of any royalties.

BACKGROUND OF THE INVENTION

In the field of aimpoint tracking, the current technology provides a fairly accurate system in which the weapon to which the pointing device is mounted is tethered to the scene containing the target. In this system, the pointing device transmits an infrared sight against a prism at the target scene and receives the reflected light back at the transmitter to determine aimpoint position with respect to the prism. It offers a fairly continuous tracking but the tether alters the touch or feel of the weapon. This altered sensation reduces the effectiveness of the aimpoint training, since in real-life use there are no tethers between the weapons and the targets.

Another currently available tracking system has no tether but fails to provide continuous tracking, showing only the point where the bullet hit. It pulses a laser against an opaque sheet of Plexiglas® and triangulates the position of the laser light pulse to determine the position of the aimpoint.

SUMMARY OF THE INVENTION

The Continuous Aimpoint Tracking System 100 (hereinafter referred to as the CATS) has the advantage of providing continuous aimpoint tracking, yet requiring no tether. It reports at a rate per second, the rate depending on the application to which the CATS is put, exactly where, in a position detection device of any given size, a laser pointing device is aimed. The CATS also reports the rotation (cant) of the pointing device. In a typical marksmanship training application, reporting at any rate of over 100 times per second is adequate. For example, applicants have demonstrated the operation of the CATS at a reporting speed of 112.5 times per second.

Laser pointing device (LPD) 101 projects an infrared laser crosshair onto position detection device (PDD) 103 that is placed at a given distance away from the LPD, the distance dictating the required spread angle of the crosshair lines from the LPD. The LPD can be attached to anything that needs accurate aimpoint from a distance of about 6 feet to about 60 feet. Of particular interest is the use of LPD in conjunction with firearm 109 such as a pistol, rifle or shotgun, which makes possible marksmanship training with a real weapon but without the use of live ammunition.

The PDD onto which the crosshair is projected is coupled to standard personal computer (PC) 107 and is comprised of a multitude of photodiodes 301 and associated circuits, the photodiodes being evenly spaced and arranged to form a frame that can be mounted on the computer display so as to surround computer display screen 105. The vertical crosshair line projecting from the LPD intersects the top and the bottom edges of the PDD while the horizontal crosshair line intersects the left and the right edges of the PDD. The PDD determines the position of the four crosshair intersections and reports them to the computer. When a "shot" is fired from the LPD, the crosshair projection is interrupted briefly (for example, 18 to 20 milliseconds). The computer, in response, generates the video signals that form the resolved aimpoint on the computer screen, matching the LPD aimpoint to the video image.

Further, the CATS is able to measure the rotation of the LPD over a range of at least 10 degrees clockwise or counter-clockwise. The CATS uses the measured rotation of the LPD as feedback to help the shooter learn to keep the weapon at a level cant, the ability to do which becomes more important as the distance to the target increases. In addition to normal bullet ballistics, the computer can simulate the effects of cant versus distance of a shot, providing realism for a marksmanship trainer that is not possible without the measurement of rotation.

DESCRIPTION OF THE PREFERRED EMBODIMENT

Figure 1:
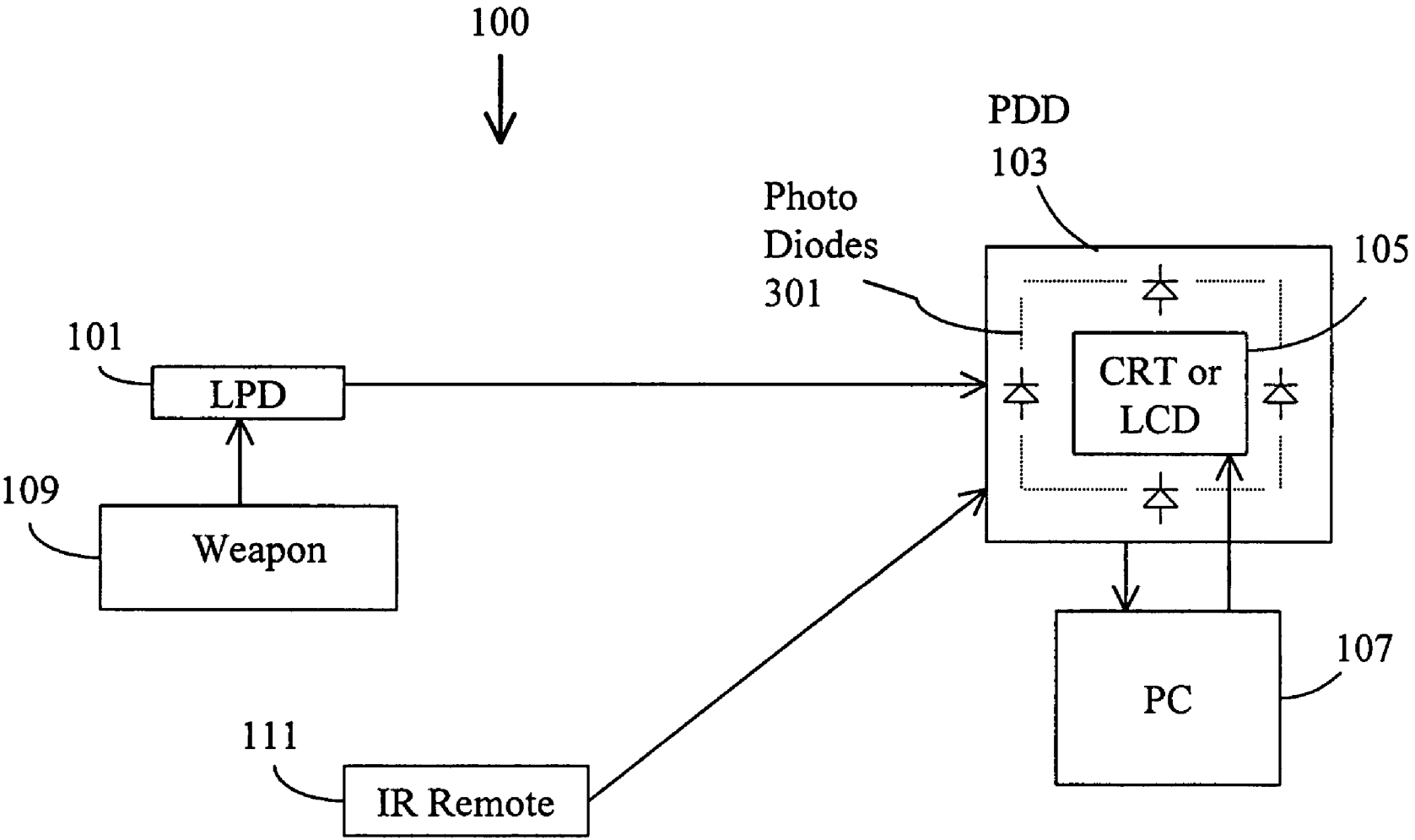
FIG. 1 is an overall functional diagram of the Continuous Aimpoint Tracking System (CATS).
Figure 2:
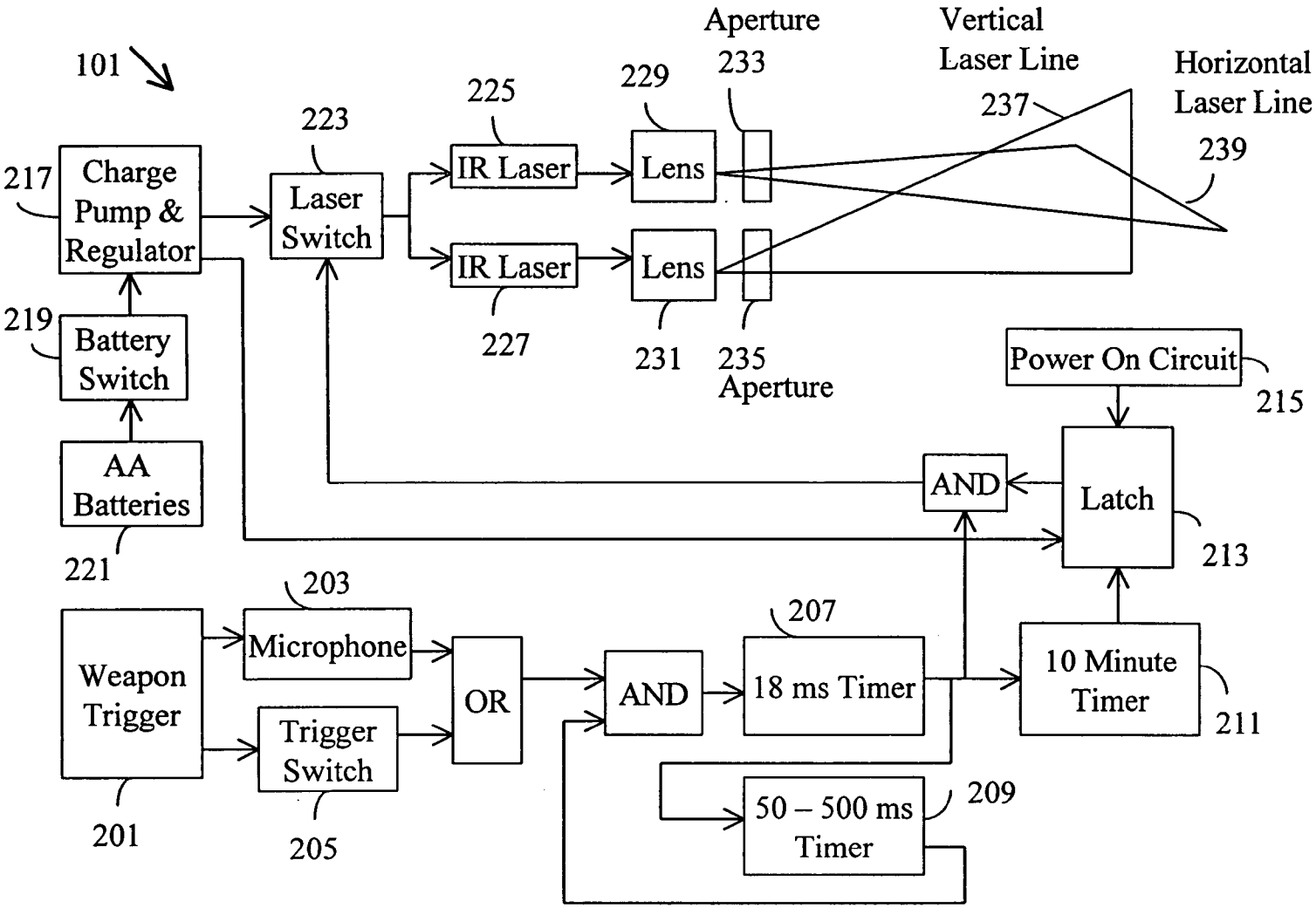
FIG. 2 presents a detailed diagram of the laser pointing device.

Referring now to the drawing wherein like numbers represent like parts in each of the several figures and arrows indicate signal paths, the structure and operation of the laser pointing device and the position detection device are explained in detail.

In use as a marksmanship trainer, the LPD is mounted onto weapon 109 such that the intersection of the projected horizontal and vertical infrared crosshairs is approximately the same as the aimpoint of the weapon. The LPD is coupled to trigger mechanism 201 so that the LPD sees a "fire" signal when microphone 203 detects the sound of the weapon's hammer as the weapon is "fired". Similarly, if a trigger switch is required, trigger switch 205 produces the "fire" signal.

The LPD is powered by batteries 221. When battery switch 219 is closed, regulator 217 provides constant voltage to first and second infrared lasers 225 and 227 and to the circuit until the batteries are exhausted, at which time it produces an under voltage signal. When power is applied to the circuit, latch 213 is set by the Power-On Circuit 215, thereby allowing the lasers to be continuously powered on.

The projected infrared crosshair can be formed in different ways. One method involves a single laser using a binary optic diffraction grating or a prism arrangement that optically converts the single laser beam into a crosshair. The preferred method, however, is to use first and second infrared lasers 225 and 227 whose output impinges on first cylindrical lens 229 and second cylindrical lens 231, respectively, each of which lenses spreads the laser beam output into a laser line with a fixed spread angle. The center halves of the resultant laser lines are usable signals that project from apertures 233 and 235, the ends of the two laser lines being blocked by the same apertures. The orientation of the laser lines is set at 90 degrees with respect to each other so that the combination of the lines form the projected crosshair that is detected by PDD 103. The ends of the projected crosshairs must be at least twice the distance between the left and right edges of the PDD. Therefore, the required minimum spread angle of the laser lines depends on the distance from the LPD to the PDD. For a typical small arms training application where the minimum distance between the LPD and the PDD is 6 feet, a minimum spread of 24 degrees is required. To achieve 6 to 30 foot distance, one may use 7 mW lasers in the LPD with 60-degree spread angle cylindrical lenses.

The projected laser crosshair lines are ideal and promote the best PDD accuracy if they have a Gaussian distribution across the width of the lines and the line width at the PDD from the normal operating distance is twice the spacing of the PDD's photodiodes. Optical methods such as using a prism arrangement or cylindrical lenses as described above produce lines with Gaussian distributions.

In a typical small arms training application, when weapon 109 is fired, first timer 207 turns lasers 225 and 227 off for a given number of milliseconds (usually 18 to 20 milliseconds), interrupting the laser crosshair. Second timer 209 is coupled to restrict the first timer from activating again until the first timer times out. If no firing of the weapon is detected for a given number of consecutive minutes, as indicated by third timer 211, or if an under voltage signal from regulator 217 appears, latch 213 is reset, thereby removing power from the lasers entirely, i.e. laser switch 223 opens. Because the lasers represent over 99% of the power requirement of the LPD, this effectively turns the LPD off. The lasers cannot be turned back on to resume operation of the LPD until battery switch 219 is turned off and then back on.

Figure 3:
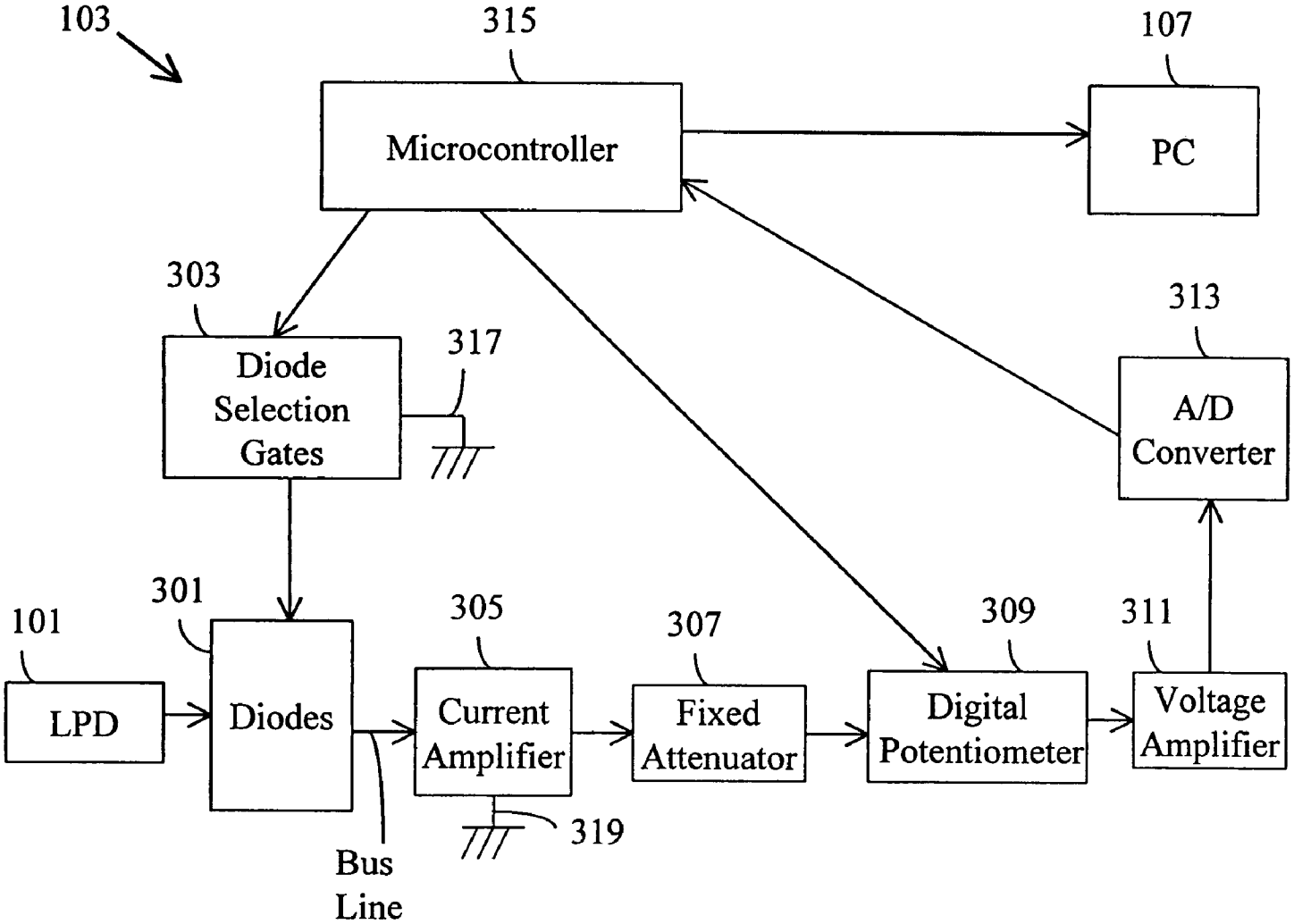
FIG. 3 presents a detailed diagram of the position detection device.

While the LPD is pointed anywhere on computer video display 105, if the laser crosshair is interrupted for a given number of milliseconds by firing of weapon 109, PDD 103 sends a "fire" event data packet to computer 107. This is explained further with reference to FIG. 3. It is noted here that even though it is contemplated that the PDD comprises a plurality of photodiodes and at least two microcontrollers to scan the photodiodes, the microcontrollers are identical in structure and function and only one is illustrated in FIG. 3. Therefore, the illustration is presented as representative only. Further, the signal processing units per microcontroller residing in the PDD are also multiple in number, each unit comprising current amplifier 305, attenuator 307, digital potentiometer 309, voltage amplifier 311 and analog-to-digital (A/D) converter 313. The preferred embodiment of the PDD envisions eight such signal processing units per microcontroller. But since they are identical in structure and function, again only one such unit is shown in FIG. 3 for representative and illustrative purposes only.

The PDD is essentially a rectangular frame that is mounted on video display (screen) 105 and surrounds the display without blocking the video image appearing on the video display. The PDD is plugged into a serial port or a universal serial bus (USB) port (e.g. a communications port) of personal computer 107. The area of video display 105 is the tracking area. Along the edges of the four sides of the PDD's rectangular frame are a plurality of photodiodes that are positioned to maintain a precise, pre-selected spacing between them. To accommodate a crosshair laser line width of 0.3 inch at the PDD, the spacing between any two photodiodes in the same horizontal row or vertical column should be 0.15 inch. The desired number of the photodiodes depends on the desired size of the tracking area. In a preferred embodiment of the PDD to be used in small arms training, the top and bottom horizontal rows each has 112 infrared photodiodes while the left and right vertical columns each has 96 photodiodes.

Two microcontrollers are employed to scan the photodiodes, each microcontroller scanning half (one horizontal row and one vertical column) of the PDD array perimeter. The two microcontrollers communicate with each other so as to coordinate the scanning of all of the 416 photodiodes in a sequential manner and one of the microcontrollers is further programmed to communicate with the computer. Among the photodiodes in the half of the PDD array perimeter (one horizontal row and one vertical column) that is coupled to be scanned by a particular microcontroller between the two microcontrollers, every $8^{th}$ photodiode is connected to one bus line of an 8-line bus. Each of the bus lines, in turn, is coupled to a signal processing unit comprised of a current amplifier, a fixed attenuator, a digital potentiometer, a voltage amplifier and an analog-to-digital converter.

FIG. 3 shows one of the eight identical photodiode busses and one of the eight identical signal processing units that are coupled to a particular one of the two microcontrollers. The decision to use two microcontrollers is based on the length, high impedance and settling times of the analog bus, the desired accuracy and the aimpoint position reporting speed. Accuracy suffers if the bus does not have sufficient time to settle after a photodiode selection has been made for scanning. Correspondingly, if less accuracy is permissible (such as caused by noise from a longer bus and/or the result of less settling time on the bus), then the PDD can be built using one microcontroller.

Every 8.89 milliseconds, the PDD measures the signal provided by each of photodiodes 301 with microcontroller 315 sequentially selecting each photodiode to be scanned. Diode selection gate 303 acts as a selection switch sequentially to connect a single selected diode to diode common 317. Each photodiode has its own diode selection gate that is coupled to the diode common and is selected by particular microcontroller 315. While a selected photodiode is being scanned, all other photodiodes on the same bus are isolated.

The signal of the selected photodiode appears as a small current (example: 0 to about 600 nanoamps), generated in response to the infrared radiation (in the form of crosshair) impinging on the photodiode. Current amplifier 305, then, converts the photodiode current to a voltage that provides enough current through a high resistance (example: 1.5 megohm) to balance the current of the photodiode so that the bus voltage can be kept at the voltage common 319 potential. The voltage developed by the current amplifier balances the photodiode's current and is of low impedance. Fixed attenuator 307 reduces this voltage and applies the reduced voltage across digital potentiometer 309 whose attenuation step is set by particular microcontroller 315. All of the digital potentiometers' settings are independently set for each row and column of photodiodes, and all photodiode signals in any one row or column are measured with all 8 digital potentiometers set to the same step during a single scan of the row or column. The output voltage from digital potentiometer 309 is input to fixed gain voltage amplifier 311, which, in response, produces a low impedance output signal. The output signal of the voltage amplifier is, then, input to A/D converter 313, which yields a corresponding 8-bit digital value. The digital value is input to particular microcontroller 315 which, in turn, sends corresponding data packets to computer 107. Such data packets are sent from the PDD to the computer at an exemplary rate of 112.5 data packets per second, the result of the microcontrollers scanning all of the photodiodes every 8.89 milliseconds.

When the laser crosshair projection from the LPD is crossing inside the detection area of the PDD, the PDD determines the positions of the laser crosshair crossings at its edges and reports these to the computer 112.5 times per second. In response, the computer determines the aimpoint relative to the PDD as the intersection of the two lines formed by connecting the top and bottom edge laser crosshair positions, and the left and right laser crosshair positions. The computer determines the rotation angle from the horizontal line of the crosshair because it gives the best accuracy. The computer uses this information to update the video image in the display area of the PDD as required. The computer can adjust the aimpoint relative to the video image as required to align the PDD to the displayed video image; therefore, the LPD needs no aimpoint adjustment and the PDD needs no critical alignment to the video image. Only the video image size is required to be exact and the image linear. The aimpoint remains accurate when the LPD is rotated to angles of up to about 10 degrees, as long as the laser crosshair lines continue to intersect all four edges of the PDD.

When weapon 109 is triggered, the LPD infrared crosshair projection is interrupted briefly, most likely 18 to 20 milliseconds. When this happens, because the PDD saw the laser on all four edges, then sees nothing for at least one scan (8.89 milliseconds), and then again sees the laser on all four edges, it determines that the LPD has been triggered, and the PDD reports this as a "fire event" to the computer. The computer uses the last reported position of all four edges as the aimpoint at the moment that the shot was fired. When the crosshair signals are continuously (more than about 6 scan periods) detected on less than all four edges of the PDD, the microcontroller reports this to the computer as an "off screen" event. During the transitions that occur during a "fire event" and between normal position reporting and "off screen" events, there are scans that result in no reports being sent to the computer.

Four LED indicators, one for each edge of the PDD, are located and visible at one corner of the PDD to indicate whether or not a laser crosshair line is touching each respective edge of the PDD. The LED is off when any laser line is crossing its respective edge of the PDD. When lasers 225 and 227 are momentarily interrupted while the LPD is pointed toward the tracking area, these LED indicators flash on.

The resolution of the aimpoint at the PDD, assuming a 13 by 10 inch tracking area, is approximately 0.0006 inch with the accuracy being better than +/−0.01 inch. The photodiodes have randomly different sensitivities, and the analog channels are not perfectly matched. Therefore, to achieve the specified accuracies, a one-time in-circuit calibration is required to equalize the gain of all photodiodes. Calibration is performed by illuminating the entire PDD with a uniform level of infrared radiation and running a suitable PC-based calibration program. During calibration, the PDD sends the raw digital values of all 416 photodiodes to the calibration program. Several complete scan samples should be taken and averaged. The high diode value of each row and column is compared to all other diode values of the same row or column to determine the multiplier needed to make all diode values equal to the high diode value. When the calibration is successful, the calibration constants are downloaded from the computer to the PDD, which, then, uses these gain equalization multiplier values to equalize the gain of the photodiodes during normal operation of the Continuous Aimpoint Tracking System.

Depending on the environment in which the CATS is used, the performance of the CATS can be much improved by use of filters placed in front of the photodiodes. Saturation of the analog circuits occurs when the ambient infrared illumination level drives the current amplifier to saturation, rendering the PDD inoperative. Prior to saturation of the analog circuits, as the ambient infrared radiation level increases, the laser power must also increase to maintain the same performance level of the PDD. The most effective way to reduce the ambient infrared radiation level is to install a bandpass filter in front of the photodiodes to eliminate all infrared radiation above the LPD laser's wavelength (the photodiodes themselves have a built-in filter to block all visible light). This significantly improves the overall performance of the PDD because the bandpass filter passes about 80% of the laser signal, while removing about 80% of the signal from normal ambient infrared sources. Alternatively, or in combination with the bandpass filter, a set of circular polarization filters can be installed, one in front of the lasers at the LPD, and another in front of the photodiodes. However, this method requires about 50% more initial laser power to achieve the same signal at the PDD. The best scenario is to use no filters and avoid operating the CATS in areas where high levels of ambient infrared illumination are present.

The CATS can be used to measure and improve the cant of the shooter manipulating the weapon. Long-distance shooters need to be especially aware of the cant of their weapon because a cant of 1 degree can cause the bullet to miss by several feet from a distance of 1600 meters (1 mile).

With the LPD attached to anything that rotates over a small angle (5° being the maximum sweep), the sweep of the laser lines in the tracking area at a distance of 15 feet away from the LPD provides two axis rotational measurements to 0.0003 degrees and a cant measurement to 0.006 degrees. These three angular measurements represent all three degrees of movement that are available from a single point in space: azimuth, elevation and rotation.

Although a particular embodiment and form of this invention has been illustrated, it is apparent that various modifications and embodiments of the invention may be made by those skilled in the art without departing from the scope and spirit of the foregoing disclosure. One such modification is using a standard "universal" multi-device television remote control transmitter 111 to act as an instructor console to control several PDD's in the same room. For example, if seven PDD's are used, each PDD is assigned a number from 1 to 7 that corresponds to the remote's various devices, like "TV", "VCR", etc. When a selected PDD sees a command that has the coding of the selected device, it responds by forwarding the command to computer 107, causing various actions to take place. Another modification is to enclose the PDD in an aluminum enclosure with slits cut on the front side near the outer edges to allow the laser crosshair projections to reach the photodiodes that are in line behind the slits. This reduces the ambient infrared illumination levels impinging on the photodiodes, thus improving performance of the PDD. The aluminum enclosure further acts as a static shield for the high impedance analog circuitry associated with the nano ampere range signals that are generated by the photodiodes. Additionally, the enclosure may have adjustable mounts that fit almost any brand of video monitor, and may be held in place by Velcro on the brackets. Yet another modification is to enclose the computer and the video display (as a Thin Film Transistor Liquid Crystal Display) in the aluminum enclosure with the PDD, making an all-in-one system.

To those skilled in the art of position and angular measurement, the invention described above can be applied to other uses where a non-contact, non-tethered, high-precision method of measurement of position and/or angle is required. One example is a numerical controlled machine tool.

Another exemplary application is a two-axes high precision angular resolver for machines. Computer games are another potential application.

Accordingly, the scope of the invention should be limited only by the claims appended hereto.

We claim:

1. A continuous aimpoint tracking system for continuously tracking the aimpoint and cant of a shooter, said system comprising: a computer having a video display for displaying on said video display the aimpoint and cant; a laser pointing device to be manipulated by said shooter, said laser pointing device being adapted for emitting laser aim signals and being positioned relative to said video display so as to allow the shooter to aim laser signals at any pre-selected area of said video display; a position detection device, said detection device being coupled to said computer and mounted thereon so as to frame said video display, said detection device sensing said laser aim signals being emitted from said pointing device and generating corresponding data packets at a rate of at least 112.5 times per second and sending said data packets to said computer, said computer processing said data packets to produce and display video signals indicative of the exact location of said aim signals on said video display.

2. A continuous aimpoint tracking system for continuously tracking the aimpoint and cant as set forth in claim 1, wherein said position detection device comprises: a plurality of photodiodes for producing current signals in response to laser signals impinging thereon, said photodiodes being disposed in a first and a second horizontal rows, said horizontal rows being identical in structure and function, and in a first and a second vertical columns, said vertical columns being identical in structure and function, said rows and columns jointly forming a frame suitable for mounting on said video display of said computer so as to surround said video display; a means for processing said current signals to yield corresponding digital signals; and a plurality of bus lines coupled between said photodiodes and said processing means to enable sequential scanning of said photodiodes, such that every $8^{th}$ photodiode in a pair of one horizontal row and one vertical column is coupled to the same bus line among said plurality of bus lines, said digital signals being subsequently converted into data packets at a rate of at least 112.5 times per second and input to said computer.

3. A continuous aimpoint tracking system for continuously tracking the aimpoint and cant as set forth in claim 2, wherein any adjacent two of said photodiodes in the same horizontal row or vertical column are further disposed to maintain the exactly same pre-selected spacing therebetween, said spacing being equivalent to the width of said laser aim signal.

4. A continuous aimpoint tracking system as set forth in claim 3, wherein said means for sequential scanning comprises: a pair of mutually coordinating first and second microcontrollers, said first microcontroller being coupled to scan said first row and said first column of said photodiodes while said second microcontroller is coupled to scan said second row and said second column of said photodiodes; a means for isolating any selected photodiode from other photodiodes on the same bus line so that sequential scanning can be performed by a particular microcontroller among said microcontrollers, said particular microcontroller being coupled to said selected photodiode, said isolating means being coupled between said photodiodes and said particular microcontroller.

5. A continuous aimpoint tracking system as set forth in claim 4, wherein one of said microcontrollers communicates with said computer.

6. A continuous aimpoint tracking system as set forth in claim 5, wherein said laser pointing device for emitting laser aim signals comprises: a plurality of lasers for emitting infrared beams, said beams exhibiting a Gaussian distribution across the width of said beams; a means for powering said lasers; a means for selectively activating said lasers; and a means positioned to receive said infrared beams from said lasers, shape said beams and subsequently project said beams in the form of a crosshair onto said position detecting device.

7. A continuous aimpoint tracking system as set forth in claim 6, wherein said means for shaping and projecting a crosshair comprises: a first cylindrical lens and a second cylindrical lens, each of said lenses being positioned to receive said infrared laser beam from said first laser and said second laser, respectively, and optically diffract said radiation into a horizontal line and a vertical line, respectively, each line exhibiting a Gaussian distribution, said horizontal and vertical lines together forming a crosshair.

8. A continuous aimpoint tracking system as set forth in claim 7, wherein the length of said horizontal line spans at least twice the distance between the outer edges of said vertical columns of said photodiodes in said position detection device.

9. A continuous aimpoint tracking system for continuously tracking the aimpoint of a shooter, said system comprising: a computer having a display screen for displaying on said screen the aimpoint; a laser pointing device manipulable by said shooter, said laser pointing device being suitable for emitting laser aim signals that exhibit a Gaussian distribution across the width of said signals and being positioned relative to said display screen so as to allow the shooter to aim said laser signals at any pre-selected area of said screen; a position detection device coupled to said computer, said position detection device having therein a plurality of photodiodes for producing current signals in response to laser signals impinging thereon, said photodiodes being disposed in a first and a second horizontal rows, said horizontal rows being identical in structure and function, and in a first and a second vertical columns, said vertical columns being identical in structure and function, said rows and columns jointly forming a frame suitable for mounting on said screen of said computer so as to surround said screen, said position detection device further having therein a means for scanning said photodiodes in a predetermined sequence, a microcontroller coupled to scan said photodiodes, a means for processing said current signals to yield corresponding digital signals, a plurality of bus lines coupled between said photodiodes and said processing means such that every $8^{th}$ photodiode in a pair of one horizontal row and one vertical column is coupled to the same bus line among said plurality of bus lines; and a means for isolating any selected photodiode from other photodiodes on the same bus line so that sequential scanning can be performed by said microcontroller, said isolating means being coupled between said photodiodes and said microcontroller, said digital signals being subsequently converted into data packets and input to said computer at a rate of at least 112.5 times per second and said computer processing said data packets to produce and display video signals on said screen, said video signals indicating location of said aim signals with an accuracy of +/−0.01 inch.

10. A continuous aimpoint tracking system as set forth in claim 9, wherein said means for processing said current signals comprises: a plurality of identical processing units, each of said units comprising a current amplifier coupled to one of said bus lines, said current amplifier producing corresponding voltage signals in response to said current signals received from said selected photodiode; a digital potentiometer set at a pre-selected attenuation step; a fixed attenuator coupled between said current amplifier and said digital potentiometer, said attenuator receiving said voltage signals from said current amplifier and rendering said voltage signals acceptable to said potentiometer; an analog-to-digital converter coupled to said microcontroller, said converter producing digital output signals in response to voltage input signals and transmitting said digital output signals to said microcontroller; a voltage amplifier coupled between said digital potentiometer and said analog-to-digital converter, said voltage amplifier receiving signals from said digital potentiometer and producing, in response, low-impedance signals, said voltage amplifier further transmitting said low-impedance signals to said analog-to-digital converter.

* * * * *